US005527207A

United States Patent [19]

Azar et al.

[11] Patent Number: 5,527,207

[45] Date of Patent: Jun. 18, 1996

[54] DUST COLLECTION SHROUD FOR HAND HELD POWER TOOLS

[76] Inventors: John C. Azar, 841 Taaga Pl., Sarasota, Fla. 34232; Dale E. Aschliman, 6117 Camphor Ave., Sarasota, Fla. 34231

[21] Appl. No.: 266,369

[22] Filed: Jun. 27, 1994

[51] Int. Cl.[6] ..... B24B 23/02

[52] U.S. Cl. ..... 451/344; 451/359; 451/451; 451/456

[58] Field of Search ..... 451/92, 344, 345, 451/354, 359, 451, 455, 456

[56] References Cited

U.S. PATENT DOCUMENTS

| | | | |
|---|---|---|---|
| 3,013,293 | 12/1961 | Schöttle | 451/456 |
| 3,826,045 | 7/1974 | Champayne | 451/456 |
| 3,880,047 | 4/1975 | Dosier | 451/456 |
| 3,882,644 | 5/1975 | Cusumano | 451/456 |
| 4,646,480 | 3/1987 | Williams | 451/456 |
| 4,765,099 | 8/1988 | Tanner | 451/456 |
| 4,986,703 | 1/1991 | Hampl et al. | 451/456 |

*Primary Examiner*—Maurina T. Rachuba
*Attorney, Agent, or Firm*—Charles J. Prescott

[57] ABSTRACT

A dust collecting device connectable to a hand held power sanding and/or grinding tool for dislodging, retention and collection of dust particles created by the abrasive process by the power tool. The device includes a flat disc-shaped shroud top having central aperture means formed therethrough for fastener connection to, and output shaft clearance of, the power tool. An upwardly facing exhaust port is also connected to the shroud top for attachment to a vacuum source for collecting particles dislodged by the abrasive process from a work surface. The device also includes a circular brush member defining a somewhat flexible skirt formed of densely spaced bristles dependently extending generally orthogonally from one surface of the shroud top immediately adjacent its circular perimeter. The skirt encircles and encloses a rotating or oscillating abrasive pad connected to the output shaft of the power tool. A flexible plastic stiffener is embedded within the bristles of the skirt to provide support for the power tool and to define an enclosure in cooperation with the work surface and the shroud top to surround the abrasive pad. The stiffener extends only part way from the shroud top toward the ends of the bristles to allow air to flow by vacuum suction through a gap between the stiffener and the work surface, the stiffener helping to contain dust particles within the skirt for vacuum removal through the exhaust port. The shroud top may be transparent to permit better viewing of the work surface as sanding or grinding progresses.

3 Claims, 3 Drawing Sheets

DUST COLLECTION SHROUD FOR HAND HELD POWER TOOLS

BACKGROUND OF THE INVENTION

SCOPE OF INVENTION

The present invention relates to a device used for the collection of dust. More specifically, the present invention relates to a dust collection device for hand held power tools.

PRIOR ART

In the manufacturing process, there is a requirement to collect particulates generated by manufacturing processes. These processes involve drilling, grinding, sanding and other similar abrasive techniques. Particulate collection is done to prevent ingestion of the particulates by personnel, to provide for a clean and visible work piece during manufacturing processes, and to reduce general contamination of the work place and work surface.

The importance of dust collection is well understood. This problem has been addressed in the past by locally shrouding both the work piece and the abrasive surfaces. This shrouding typically consists of a rigid opaque housing attached to the hand held tool. The interface between the rigid housing the work piece is a solid rubber-like gasket material.

Other approaches to this problem include devices as described above, but do not include the gasket like material. These types of devices use the bottom of rigid housing as the work piece interface. Another approach to dust collection is the utilization of abrasive media, which is mounted to a surface and made in such a way as to allow the dust particles to pass through it. Dust collection for all of the above approaches is accomplished by using vacuum cleaners attached by a hose to the rigid dust collection housing.

The current art of hand held tool dust collection relies on the rigid housing's close interface with the work piece to be effective in vacuuming up the dust particulate. The rigid housing's close proximity with the work piece is also required to contain particulates through at high speeds by the abrasive processes.

The required close proximity to the work piece can also cause both the rigid housing material and the solid rubber like gasket materials, as described above, to force or grind the dust particulate materials into the porous surfaces of the work piece, often scratching or damaging it. This happens when there is contact between the rigid housing, or its gasket like materials, and the work piece.

Additional difficulties with this approach include having the abrasive tool movement impeded or stopped, causing poor quality and damage to the work piece. This occurs when the smooth interface of the rigid housing and the housings that utilize solid rubber like gasket materials create a seal of such a quality that the tool is held in place or impeded by vacuum suction forces. Consistent with this problem is the corresponding reduction in air flow and particulate collection efficiency.

Whatever the precise merits, features and advantages of the above-cited references, none of them achieve or fulfill the purposes of the dust collection device of the present invention.

BRIEF SUMMARY OF THE INVENTION

This invention is directed to a dust collecting device connectable to a hand held power sanding and/or grinding tool for dislodging, retention and collection of dust particles created by the abrasive process by the power tool. The device includes a flat disc-shaped shroud top having central aperture means formed therethrough for fastener connection to, and output shaft clearance of, the power tool. An upwardly facing exhaust port is also connected to the shroud top for attachment to a vacuum source for collecting particles dislodged by the abrasive process from a work surface. The device also includes a circular brush member defining a somewhat flexible skirt formed of densely spaced bristles extending generally orthogonally from one surface of the shroud top immediately adjacent its circular perimeter. The skirt encircles and encloses a rotating or oscillating abrasive pad connected to the output shaft of the power tool. A flexible plastic stiffener is embedded within the bristles of the skirt to provide support for the power tool and creates an enclosure with the work surface and the shroud top to surround the abrasive pad. The stiffener extends only part way from the shroud top toward the ends of the bristles to allow air to flow by vacuum suction therethrough primarily in close proximity to the work surface while the stiffener helps to contain dust particles within the skirt for vacuum removal through the exhaust port. The shroud top may be transparent to permit better viewing of the work surface as sanding or grinding progresses.

It is therefore an object of this invention to provide a close proximity interface of the dust collection housing to the work piece that also provides a good air flow through the interface to eliminate stiction due to suction to the work piece and to support the hand held tool reducing operator fatigue.

It is also an object of the present invention to provide such a device which is of simple, inexpensive construction and which is adaptable for use with most hand held abrading process tools.

Another object is to provide a sweeping effect to the interface enhancing the collection of dust particulates, including the porous areas of the work piece.

The foregoing objects can be accomplished by providing a rigid collection housing interface to the work piece that provides for both a sweeping action, while at the same time allowing air to pass through the interface.

This interface consists of densely packed fibers or bristles of similar length, that completely circles the rigid housing in a thickness that allows the passage of air in, but will not allow the migration of dust particulates outwardly therethrough.

Included within this brush like interface is a plastic stiffener, which is utilized for assistance in supporting the hand held tool, reducing operator fatigue and assists in providing improved pressure control of the abrasive media on the surface of the work piece. Since this interface allows air to pass through it at any orientation while in contact with the work piece, problems related to suction forces and stiction impeding the tool motion are eliminated. The plastic stiffener also directs the air flow through the lower portion of the bristle interface creating increased air flow to the surface of the work piece and the abrasive media, enhancing the dust collection. This fibrous and plastic interface is attached to the bottom of the shroud top.

It is therefore another object of this invention to provide a new and improved dust collection and shield device for use with hand held abrasive process power tools.

In accordance with these and other objects which will become apparent hereinafter, the instant invention will now be described with reference to the accompanying drawings.

DETAILED DESCRIPTION OF THE INVENTION

Figure 1:
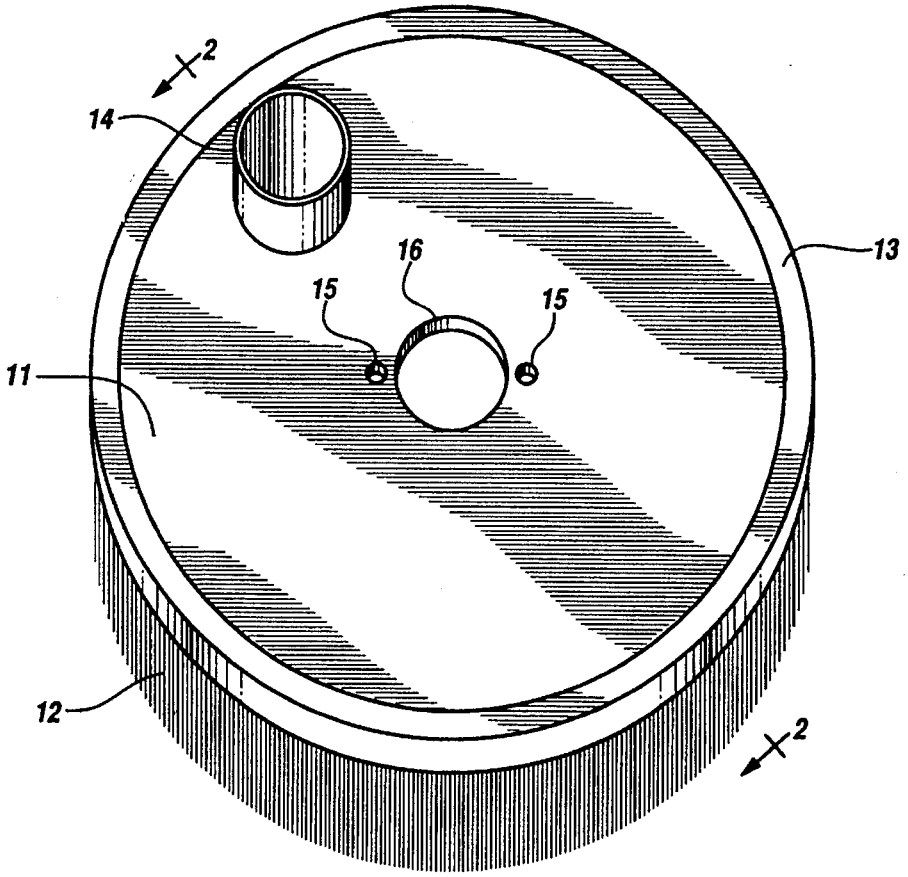
FIG. 1 is a perspective view of the collection device not attached to a hand held tool.
Figure 2:
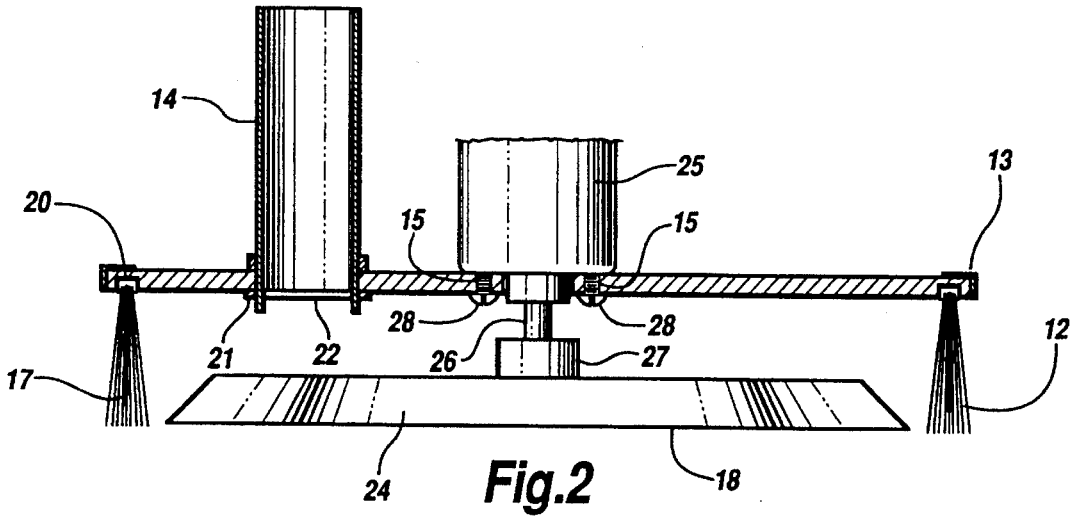
FIG. 2 is an elevation view of the collection device taken across section 2 with a hand held tool attached.

Referring to FIGS. 1 and 2, the dust collection device is shown generally at numeral 10 and is comprised of a shroud top 11, which is an integral structure made of transparent or translucent plastics such as polycarbonite or similar materials. The lower surface of the shroud has a groove 20 which encircles the lower surface of the shroud top 11 near its perimeter. A supporting brush interface 12 with an integral plastic stiffener 17 mounts in the shroud groove 20 utilizing both pressure and an adhesive to hold it in place.

The shroud top 11 has an aperture 16 located at its annulus that allows passage of the hand held tool's drive shaft 26 through the shroud top 11. Attached to the hand held tool's drive shaft 26 is the threaded collar 27 which allows attachment of the abrasive mounting pad 24. Threaded fasteners 28, located near the annulus of the shroud top 11, are used to attached the shroud top 11 to the hand held power tool 25. An exhaust port aperture 22 is located near the perimeter of the shroud top 11 at an orientation that is located at forty five degrees (45° ) from a line that is described by drawing a line through the center of the shroud top 11 and passing through the mounting holes 15.

On a bisecting line drawn through the center of the shroud top 11 annulus to the perimeters of the shroud top 11 and passing through the center of the exhaust aperture 22, mounting holes 15 which are used to pass through the threaded fasteners 28 are located on a line drawn at 45° to the bisecting line. Further, these mounting holes 15 are located on the right and left side of the drive shaft aperture 16 and near the perimeter of the exhaust port aperture 22.

Attached to the exhaust port aperture 22 by use of a locking threaded nut 21 is the exhaust port 14. The exhaust port 14 is made of a plastic material and has flange whose diameter exceeds that of the exhaust port aperture 22. The exhaust port flange seats on the top surface of the shroud top 11 and has threaded base that passes through the exhaust port aperture 22.

Figure 3:
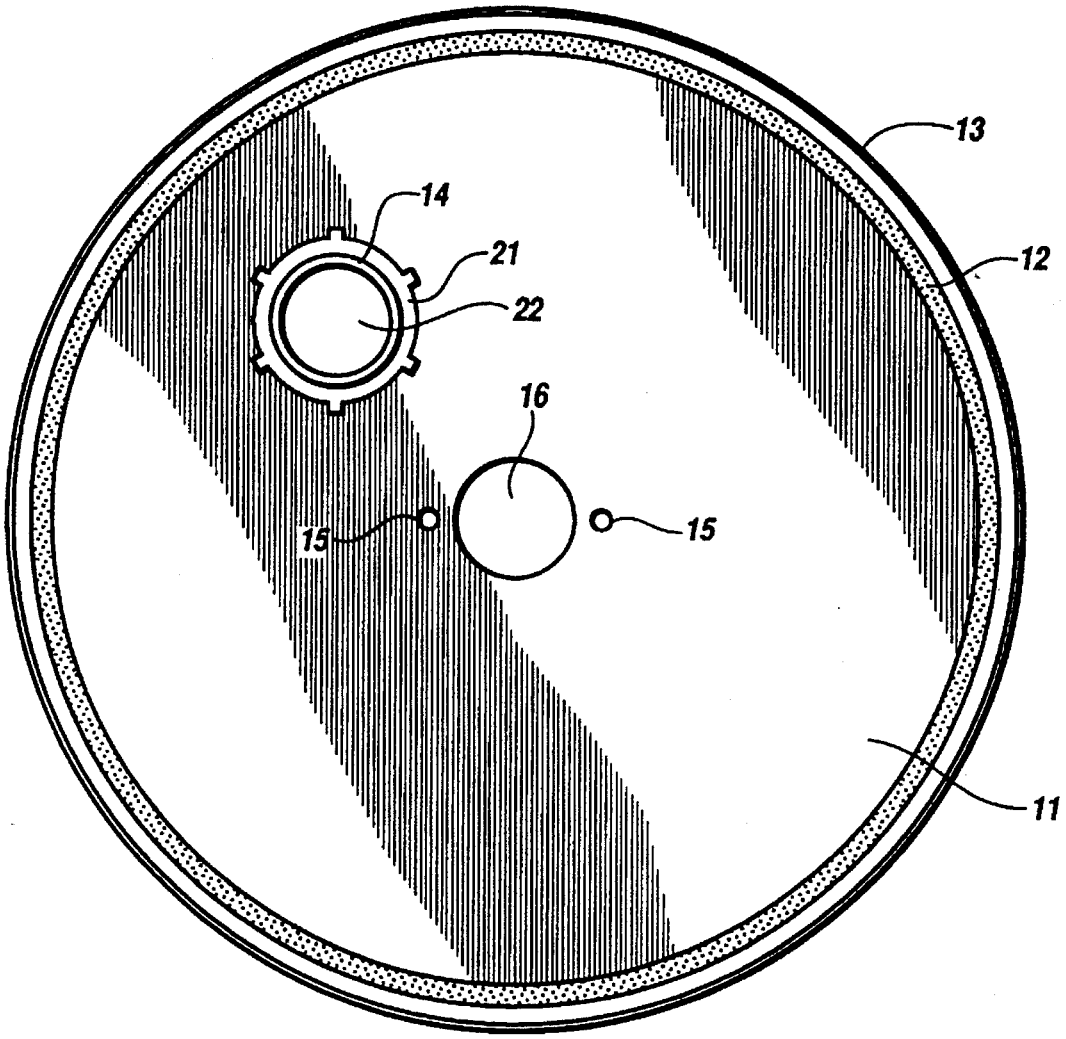
FIG. 3 is a bottom plan view of the collection device not attached to a hand held tool.
Figure 4:
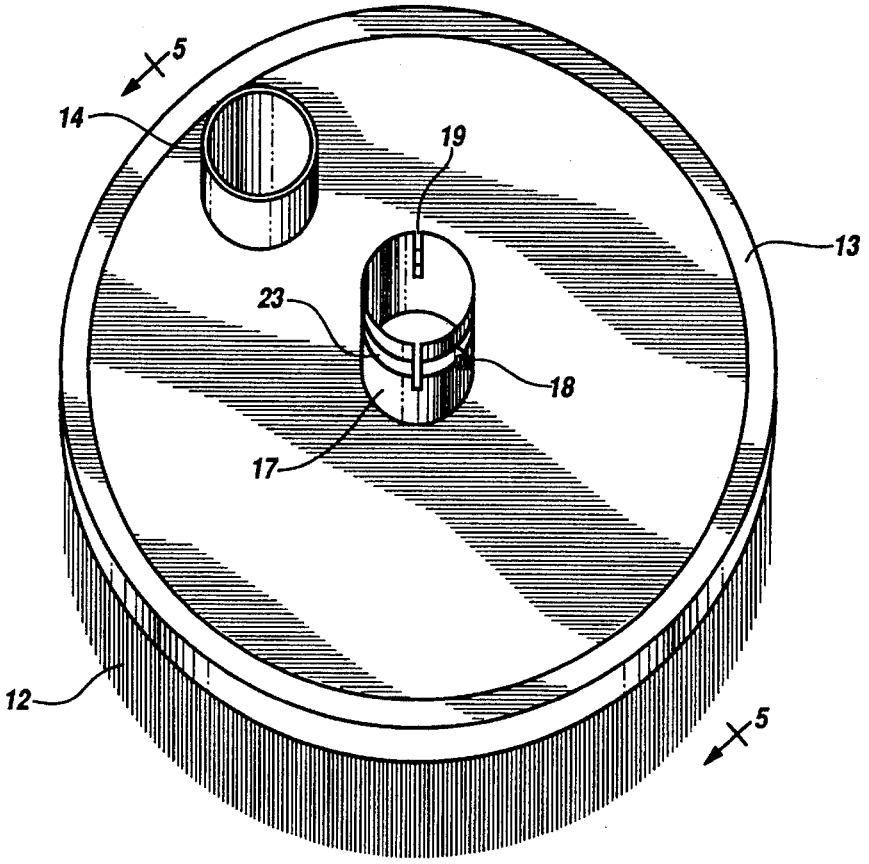
Figure 5:
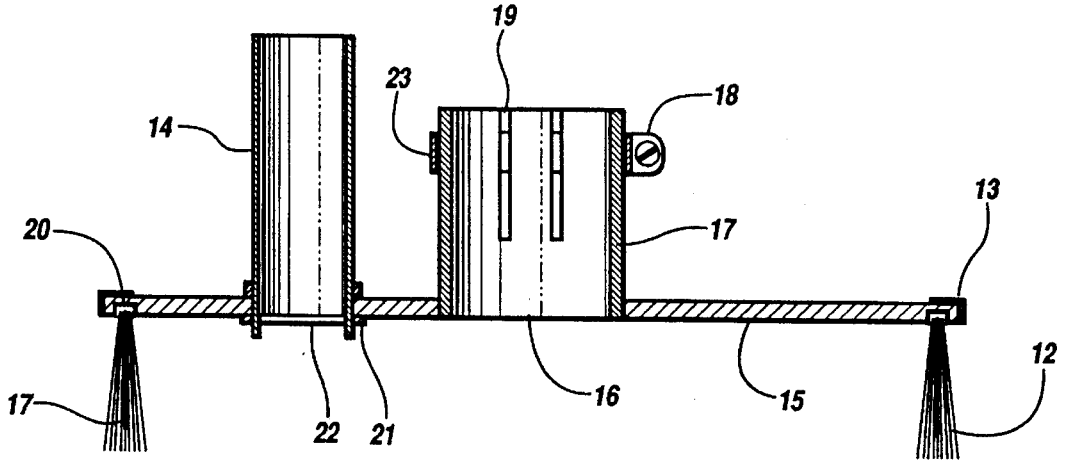

Referring to FIG. 3, the locking nut 21 is threaded onto the exhaust port 14 base and seats on the shroud top bottom securing the exhaust port 14 in place. The exhaust port 14 exit diameter is sized to allow pressure fitting attachment of a dust collection vacuum hose which is connected to a vacuum source as shown in FIG. 2.

Edge molding 13 completely encircles the perimeter of the shroud top 11 and is made of non-marring flexible plastic like material.

The shroud top 11 is attached to the base of the hand held power tool 25 by use of threaded fasteners 28. Since the location of the exhaust port 14, either to the right side or left side relative to the hand held power tool 25 and operator, is determined by the mounting orientation, the operator of the dust collection device 10 can select the preferred orientation of the exhaust port 14 and associated vacuum hosing allowing for maximum operator access to the work piece and minimizing vacuum hose interference with the work processes.

The threaded fasteners 28 are passed through the bottom of the mounting holes 15 located on the underside of the shroud top 11 and are attached to threaded holes located on the hand held power tool, thus attaching the dust collection device 10 to the hand held power tool 25. The vacuum hose is attached to the exhaust port 14 by sliding the vacuum hose over the port and pushing until a sufficient pressure fit has been attained. The threaded collar 27 is then attached to the hand held power tool drive shaft 26 by use of threads located on the threaded collar, or by means of a set screw, or a combination thereof. The abrasive mounting pad 24 is attached to the threaded collar 27 by use of threads located on the mounting pad 24 or by means of a set screw or a combination thereof.

The abrasive mounting pad 24 is adjusted to a location where the plane described by the base of the abrasive mounting pad is slightly above the plane described by the bottom of the supporting brush interface 12 and further that when the hand held tool is supported by the dust collection device 10, the abrasive mounting pad 24 with the attached abrasive media 18, is not in contact with the work piece.

With the dust collection device 10 attached to the hand held power tool 25, the vacuum hose attached to the exhaust port 14, the abrasive mounting pad 24 attached to the threaded collar 27 with proper height adjustment and with an abrasive media attached to the abrasive mounting pad, the operator may start the abrasion process.

The operator starts the hand held power tool 25 which causes rotation of the abrasive media 18 mounted on the abrasive mounting pad 24. The operator, by applying light downward pressure on the hand held power tool 25 with the attached dust collection device 10 overcomes the supporting action of the supporting brush interface 12 and the integral plastic stiffener 17 allowing the abrasive media to come in contact with the work piece. Since the shroud top 11 is transparent, the process operator can view the extent of abrasion that is occurring.

The particulates that are removed from the work piece are centrifugally flung from the work piece by the rotating abrasive media 18 and impact into the supporting brush interface 12. The vacuum source which is attached to the exhaust port 14 by means of a hose, causes air to flow through the supporting brush interface, suspends the loose particulate and pulls it out of the dust collection device 10. The location of the exhaust port 14, coupled with the rotation of the abrasive mounting pad 24, creates a cyclonic action which assists in the removal of particulate through the exhaust port.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

We claim:

1. A dust collecting device for a portable power tool having an oscillating or rotating abrasive pad comprising:

a shroud top formed of a flat disc slightly larger in diameter than that of the abrasive pad which is connected to an output shaft of the power tool;

aperture mounting means formed centrally through said shroud top for providing output shaft clearance passing therethrough and for fastener connection of said shroud top to the power tool whereby said shroud top is positioned parallel and in close proximity to the abrasive pad;

a thin continuous brush member connected to and generally orthogonally extending from adjacent a circular perimeter of said shroud top, said brush member defining a circular skirt having closely spaced bristles of a uniform length sufficient to position a distal edge of the brush member in generally coplaner alignment with, yet spaced slightly further from, said shroud top than the abrasive media of the abrasive pad;

means for connecting a vacuum source to another surface of said shroud top whereby loose particles abraded from a work surface by the abrasive pad are confined and collected by said brush member for vacuum removal;

stiffener means connected within and surrounded by said bristles for preventing air and dust particles from passing through an upper portion of said bristles and for cooperating with said bristles to support the power tool atop a work surface;

said stiffener means including a length of flat somewhat flexible plastic material coextensive with said brush member around said circular perimeter of said shroud top, said stiffener means extending across the length of said bristles from said shroud top toward, but not to a distal margin of the bristles.

2. A dust collecting device as set forth in claim 1, wherein:

said disc is transparent for viewing of the work surface therethrough while operating the power tool.

3. A dust collecting device as set forth in claim 2, further comprising:

a protective edge molding connected to and radially outwardly extending from said perimeter of said shroud top.

* * * * *